US009599434B2

(12) United States Patent
Liu

(10) Patent No.: US 9,599,434 B2
(45) Date of Patent: Mar. 21, 2017

(54) SECURE PERSONAL ITEM CARRIER WEAPON CONCEALMENT COMPARTMENT SYSTEM

(71) Applicant: Jian Liu, Plano, TX (US)

(72) Inventor: Jian Liu, Plano, TX (US)

( * ) Notice: Subject to any disclaimer, the term of this patent is extended or adjusted under 35 U.S.C. 154(b) by 0 days.

(21) Appl. No.: 14/946,666

(22) Filed: Nov. 19, 2015

(65) Prior Publication Data

US 2016/0076852 A1 Mar. 17, 2016

Related U.S. Application Data

(63) Continuation-in-part of application No. 13/867,798, filed on Apr. 22, 2013, now abandoned.

(51) Int. Cl.
*F41C 33/06* (2006.01)
*A45C 3/00* (2006.01)
*F41C 33/02* (2006.01)

(52) U.S. Cl.
CPC ..... *F41C 33/06* (2013.01); *A45C 3/00* (2013.01); *F41C 33/0209* (2013.01)

(58) Field of Classification Search
CPC ..... F41C 33/0209; F41C 33/048; A45C 1/04; A45C 3/005
See application file for complete search history.

(56) References Cited

U.S. PATENT DOCUMENTS 1,828,342 A * 10/1931 Sachs ..... A45C 3/06 150/101
5,894,975 A * 4/1999 Holden ..... A45C 1/024 150/101
5,967,393 A * 10/1999 Clarke, III ..... F41C 33/0218 206/317
2006/0208857 A1* 9/2006 Wong ..... F41C 33/0209 340/5.82
2015/0027025 A1* 1/2015 Mantua ..... F41C 33/0236 42/90
2016/0010948 A1* 1/2016 Gerdes ..... A45C 3/06 150/117

* cited by examiner

*Primary Examiner* — Corey Skurdal
(74) *Attorney, Agent, or Firm* — Braxton, Hilton & Perrone, PLLC

(57) ABSTRACT

A system and method for a secure weapon concealment compartment situated in a personal carrying item such as a purse, handbag, briefcase, backpack or luggage that allows a person to safely and efficiently carry, store and make available for use a weapon. The concealment compartment includes weapon securing having tapered holders or orifices formed to receive a weapon and provide safety against unintentional discharge of the weapon and resistive forces applied to a protective carrier of the weapon once stored to enable quick and effective withdrawal of the weapon from the concealment compartment.

10 Claims, 17 Drawing Sheets

SECURE PERSONAL ITEM CARRIER WEAPON CONCEALMENT COMPARTMENT SYSTEM

CLAIM TO PRIORITY

This application is a continuation-in-part application of co-pending U.S. patent application Ser. No. 13/867,798, filed Apr. 22, 2013.

BACKGROUND OF THE INVENTION

Technical Field

The present invention relates to a system and method for a secure weapon concealment compartment situated in a personal carrying item such as a purse, handbag, briefcase, backpack or luggage that allows a person to safely and efficiently carry, store and make available for use a weapon.

Description of Related Art

In various jurisdictions, weapons such as a hand gun must be carried and maintained according to concealed carry laws and regulations. For some gun owners, it is desirable to carry and conceal a weapon in a carrying item primarily made for carrying other items, such as a handbag, purse, briefcase, backpack or various forms of luggage. Existing products that incorporate a holster are not seamlessly integrated with products and, accordingly, do not lend themselves to safe and efficient use, while maintaining the secret location of the weapon and the overall style of the carrying item. Thus, there is a need in the art for a carrying item having a weapon holder that is seamlessly integrated into the carrying item while maintaining concealment of the weapon, weapon safety and not departing from the aesthetic characteristics of the carrying item.

BRIEF DESCRIPTION OF THE DRAWINGS

The novel features believed characteristic of the invention are set forth in the appended claims. The invention itself, however, as well as a preferred mode of use, further objectives and advantages thereof, will be best understood by reference to the following detailed description of illustrative embodiments when read in conjunction with the accompanying drawings, wherein:

DESCRIPTION OF THE EMBODIMENTS

Figure 1:
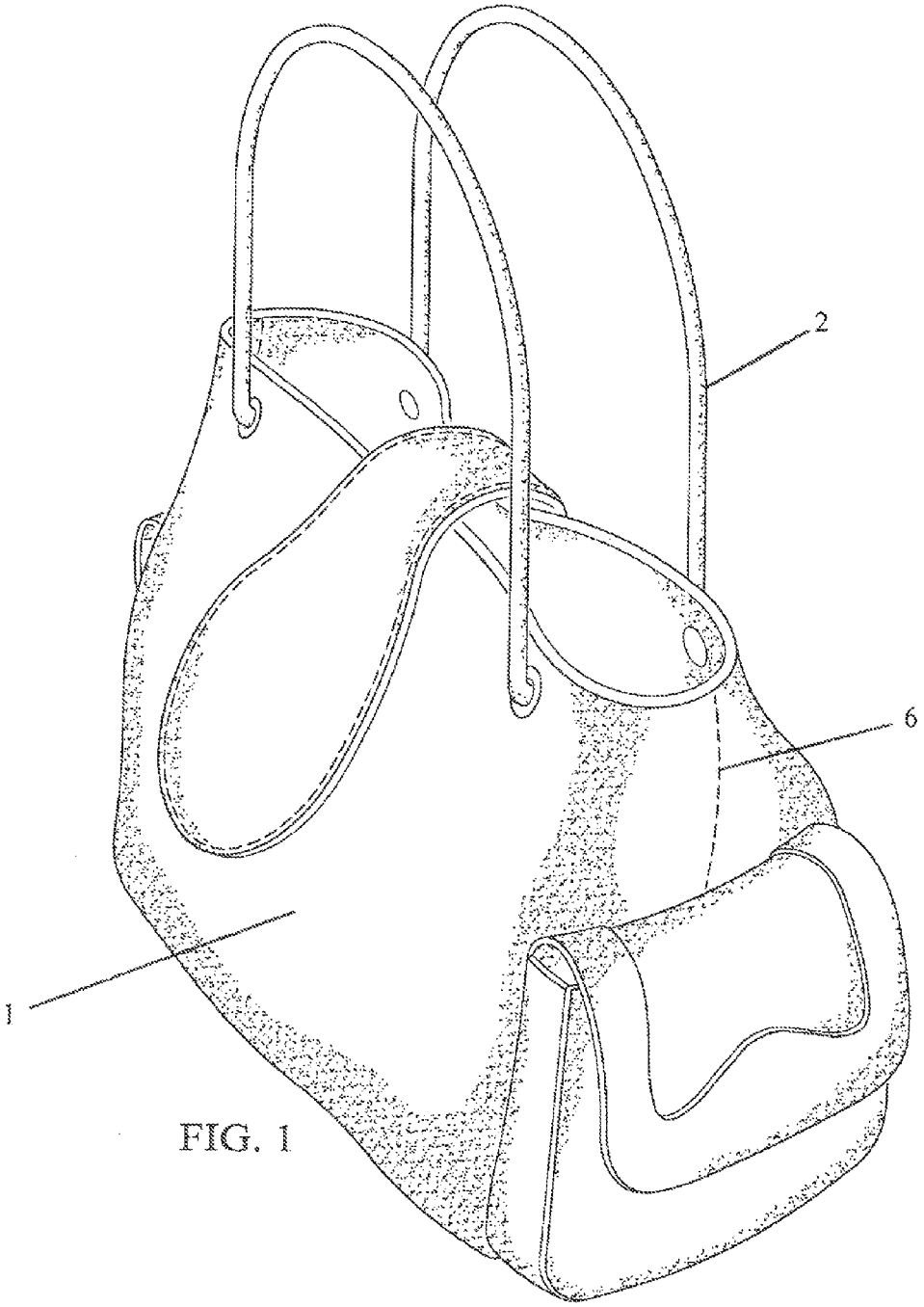
FIG. 1 is a perspective view of the holster purse system.

Several embodiments of Applicant's invention will now be described with reference to the drawings. Unless otherwise noted, like elements will be identified by identical numbers throughout all figures. The invention illustratively disclosed herein suitably may be practiced in the absence of any element which is not specifically disclosed herein.

Gun owners often desire to conceal their weapons from open view. In addition, many states laws only permit concealed carry and not open carry. A concealed holster allows a user to carry a weapon, while maintaining the use of both hands. A concealed weapon allow a user to maintain the element of surprise when the time arises to use the weapon since the weapon is not visible to passersby. Most holsters remain hidden from view yet still accessible should the user feel threatened or encounter a dangerous situation.

A holster is an item in which a weapon such as a hand gun is placed to secure the handgun to the user. A holster typically conforms to the shape and size of the weapon that it is intended to receive. The purpose of the holster is for the user to safely maintain the weapon in a readily accessible position should the need to use it arise. Images of a police officer or military personnel having a service pistol at his or her side while on duty may come to the reader's mind as the classic example of a weapon placed in a holster. While a peace officer may want his sidearm in a location that is both visible to the public and easily drawn, citizens carrying a handgun typically do not want the weapon to be in public view (and my by law be required that it not be). At the same time, the citizen's weapon needs to be readily available should the need to use it arise.

Some holsters are worn at the waist. The typical holster is constructed of a durable material that will withstand repeated insertion and removal of an associated firearm. Holsters may be fabricated from a variety of materials such as cotton, nylon, plastic, leather or other natural or synthetic materials. Holsters usually are accompanied by a strap arrangement that may be integrated with the holster as a single unit. Alternatively, the holster may be constructed so a strap or belt may be inserted in slots formed in the holster. Holsters are available for attachment to the ankle, thigh, or shoulder. Holsters may be worn under loose clothing or concealed by a sports coat or shirt or other outerwear worn over clothing. Traditional holsters are, therefore, in a sense concealed from view by the user's clothing. Wearing a traditional holster presents problems for certain carriers, particularly those who may not be in a position to wear the necessary outerwear or other type of clothing that lends itself to concealing a weapon. Also, unlike a peace officer, military member or other official whose duty requires carrying of weaponry, most individuals licensed to carry a concealed weapon are unlikely to want others to know of the weapon. Many individuals carry concealed weapons for personal safety. Whether living in densely populated urban areas in which violent crime is frequent or sparsely populated rural areas, many carry concealed handguns for peace of mind and to increase the likelihood of preventing or surviving a violent attack. Although many individuals want to carry a weapon, the means for doing so in a nonintrusive yet safe manner is desirable. The weapon carrying apparatus of the present invention provides an integrated solution.

For many users, use of holster in a traditional sense (attached to a belt and worn on the waist, shoulder, etc.) is not likely to be well concealed or otherwise desirable due to the slight width of the belt or location where the holster needs to be worn. Thus, concealment of a weapon in a personal item carrier, such as a purse, handbag, briefcase, backpack or luggage item is a viable option. Although a weapon can be concealed in a fanny pack, the pack will become bulky and even more unsightly with the enclosed weapon.

Purse holsters are another method of accomplishing concealed carry. Frequently, the holster compartment of the traditional purse holster is located in the middle section of inside of the purse. Often times, the zipper or opening to the compartment is positioned at either end of the handbag or purse or outside end of a handbag. This positioning is problematic because the zipper or containment mechanism is visible to passersby, alerting them to the presence of the "hidden" compartment. In addition, the hidden compartment will be accessible to passersby who may desire to disarm the user. In addition, due to the slim nature of the holster compartment opening, the weapon is not easily inserted into or removed from the thin compartment. Often times, the weapon may snag on the opening of the holster compartment. There is also the danger of the weapon sliding about the holster compartment. A loose weapon presents a potential hazard for the owner of the weapon as well as any persons in the surrounding area. Criminals of today are aware that weapons may be hidden with purses or other fashion accessories. Traditional purse holsters draw the eye of criminals since the zipper enclosing the holster compartment is usually located on the side of the purse. As users often carry a purse holster on the shoulder, the zippered edge of the holster compartment is not only visible but is accessible by other persons since it is positioned at the outer edge of the purse. Currently existing holsters in purses are not wide enough for a user to insert her hand and fire the weapon from the holster compartment. The weapon must be removed from the holster in order for the user to properly grip and fire the weapon.

The present invention was developed to solve these shortcomings of presently available holster purses. In the present apparatus, the opening to the holster compartment is located on the back side of the purse so that said opening is positioned against the body of the user while the purse holster is in use, In addition, the entrance to the holster compartment contains an extender to create a larger opening to the holster compartment. In the present holster purse system, the concealed weapon is more accessible to the user and less visible to potential enemies. Incorporation of the present integrated holster apparatus is described in the context of a purse or handbag as the carrying item of interest. The carrying item, however, may also be a briefcase, a backpack, luggage, duffle bag or other carrying item. The holster purse system shown in FIGS. 4-6. consists of a holster compartment integrated into a carrying case, purse, hand bag, briefcase, backpack, luggage or similar carrying item. The system includes a holster compartment 8, containment mechanism 4, an extender 5, and various known features of the hand bag. The holster purse system accommodates a variety of weapons, including but not limited to pistols, revolvers, knives, pepper spray, mace, and stun guns.

Holster compartment 8 secures the subject weapon inside the holster purse system. In this embodiment, the holster compartment 8 is located on the interior side of the purse or handbag. The holster compartment 8 lies within the exterior wall of the purse. The holster compartment 8 is not visible to passersby due to its location inside the holster purse system. In addition, the holster compartment 8 may be shaped to mimic the contours or outline of the weapon. In this embodiment, the shape of the holster compartment 8 is comparable to that of a handgun, but holster compartment 8 may be shaped to conform to the general shape of other items for concealment such as knives, spray mace or other repellant. The holster compartment 8 may be constructed from or lined with a variety of materials such as cotton, nylon, plastic or leather.

The containment mechanism 4 serves to enclose the weapon in the holster compartment 8, which is positioned within the exterior wall of said holster purse. The containment mechanism 4 extends from the bottom of the holster compartment 7 opening to the top of the holster compartment opening 7. A user would insert a weapon into the holster compartment 8 through the opening created by an open containment mechanism 4. When the containment mechanism 4 is in a closed position, the weapon is further secured inside the holster compartment 8 since it cannot easily be removed through the dosed containment mechanism 4. In this embodiment, the containment mechanism is a zipper device. However, the containment mechanism 4 could also be snaps, hook and loop fasteners, or sliders.

The exterior wall of the holster purse system also includes an extender 5 to ensure that the opening of the holster compartment 7 is sufficiently wide to accept a weapon if the opening is sized so that the weapon is a tight fit. In these circumstances, the weapon may otherwise snag or become caught at the opening of the holster compartment. Portions of a bulky weapon may become entangled with the containment mechanism 4 at the opening of the compartment 7 or the user may have difficulty forcing the weapon through the narrow space at the opening of the holster compartment 7. In the present holster purse system, the extender 5 runs from a first end of the holster compartment opening 7 to a point between said first end and the opposite edge of the holster purse system, such that the extender 5 is perpendicular to the holster compartment opening 7. The extender 5 is comprised of an extra portion of material at the opening of the holster compartment 7 that allows the opening at the corner edge of the holster compartment to open wider than the corner edge of the holster compartment without the extender. The larger opening at the edge of the holster compartment, created by the extender 5, prevents snagging of the weapon as the weapon is inserted in the holster compartment 8.

The handbag or purse in the present system is a carrying case used by persons to transport their personal belongings throughout the day. The purse may be constructed of leather, imitation leather, nylon or any similarly sturdy material. The present embodiment of the handbag or purse includes a holster compartment 8 for carrying a concealed weapon and shoulder straps 2. However, the carrying case may or may not include shoulder straps. In various embodiments, the hand bag interior cavity of the handbag may be surrounded by two, three, four or more exterior walls. The holster compartment is integrated into the exterior wall of the handbag or carrying case. In this embodiment, the opening to the holster compartment is directed towards the forward side exterior panel 6 of the handbag. The user would access the holster compartment 8 through the open containment mechanism 4, or unzipped zipper in this embodiment. The extender 5 provides a larger opening to the holster compartment 7. As the weapon is inserted, the holster compartment opening becomes even larger due to the extra give provided by the extender 5. A bulky weapon is unlikely to become snagged or caught on the larger opening of the holster compartment. In this embodiment, the handbag shoulder straps 2 also function to steady the handbag as the user carries the handbag throughout the day. Should a situation arise where a user desires to fire the weapon, the shoulder straps 2 will provide additional balance and increase firing accuracy should the user decide to fire the weapon through the purse or carrying case. The shoulder straps also may reduce kickback from firing of the weapon, which could be hazardous to the user. The carrying item, however, could also be a backpack, briefcase, laptop computer case or item of luggage.

Once the weapon has been inserted in the holster compartment 8, the weapon is further secured by several methods. The holster compartment 8 is shaped to mimic the shape or contours of the weapon. In this embodiment, the farthest edge of the holster compartment 8, on the opposite side from the compartment opening 7, is shaped to fit snugly around the barrel of the gun. The edge of the holster compartment near the opening is shaped to fit snugly around the handle of the gun. The exterior wall of the purse 1, which contains the holster compartment 8, provides additional stability. Once the containment mechanism 4 is closed, or the zipper closed in this embodiment, the containment mechanism provides additional security against the edge of the weapon since the weapon is unlikely to be removed from the holster compartment through the closed containment mechanism; or closed zipper.

As the user carries the purse, the containment mechanism 4 and the holster compartment 8 side of the purse are hidden against the user's body. Passersby will not be able to detect any bulge from the holster compartment 8 and will not be able to detect the containment mechanism 4 since it will not be visible when positioned next to the user's body. The hidden nature of the holster compartment 8 and containment mechanism 4 help the user further conceal the presence of a weapon from possible criminals. In addition, the position of the containment mechanism 4 decreases the likelihood of a criminal stealing the weapon since the opening to the holster compartment 7 is positioned against the user's body in use. In addition, once the containment mechanism 4 is open the user can fire the weapon through the handbag or remove the weapon to fire it Should the user choose to fire the weapon through the handbag or carrying case, the user would insert her hand into the holster compartment 8, grip the weapon, aim and fire at the intended target. The shoulder strap 2 of the handbag functions to further steady the weapon and increase firing accuracy of the user.

DETAILED DESCRIPTION

Figure 2:
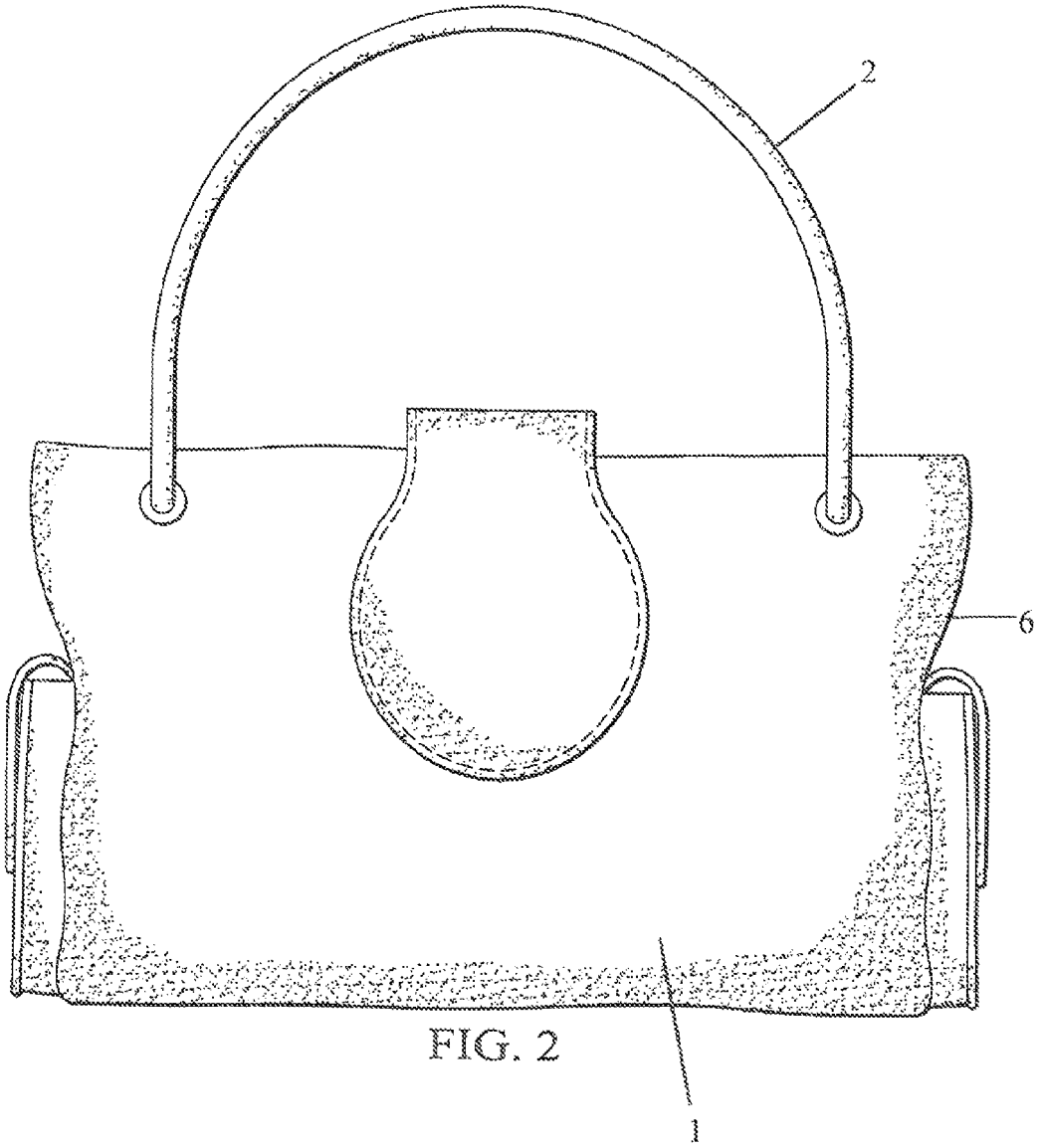
FIG. 2 is a front view of the holster purse system.

Referring generally to FIGS. 1-13, the bolster purse system allows a user to carry a weapon concealed in a handbag or purse in such a way that passersby will not detect the possible presence of the weapon. In addition, users will not encounter difficulty inserting and removing a weapon from the holster purse system. FIG. 1 shows a front perspective view of the holster purse system. On the front side of the purse, the front exterior panel 1 is visible. Directly across from the front exterior panel is the back exterior panel 3. The front exterior panel 1 and back exterior panel 3 are connected by dual side exterior panels 6. The interior storage portion, or interior cavity, of the purse is surrounded by the front exterior panel 1, back exterior panel of the purse 3, and dual side exterior panels 6. Shoulder straps 2 are attached to the top portions of both the front exterior panel 1 and the back exterior panel 3. A user of the holster purse system will insert their arm through the shoulder straps and allow the shoulder straps to rest on the user's shoulder. In use, the back exterior panel would rest against the user's body, FIG. 2 shows the front view of the holster purse system. The shoulder straps 2 are attached to the top portion of the front exterior panel 1.

Figure 3:
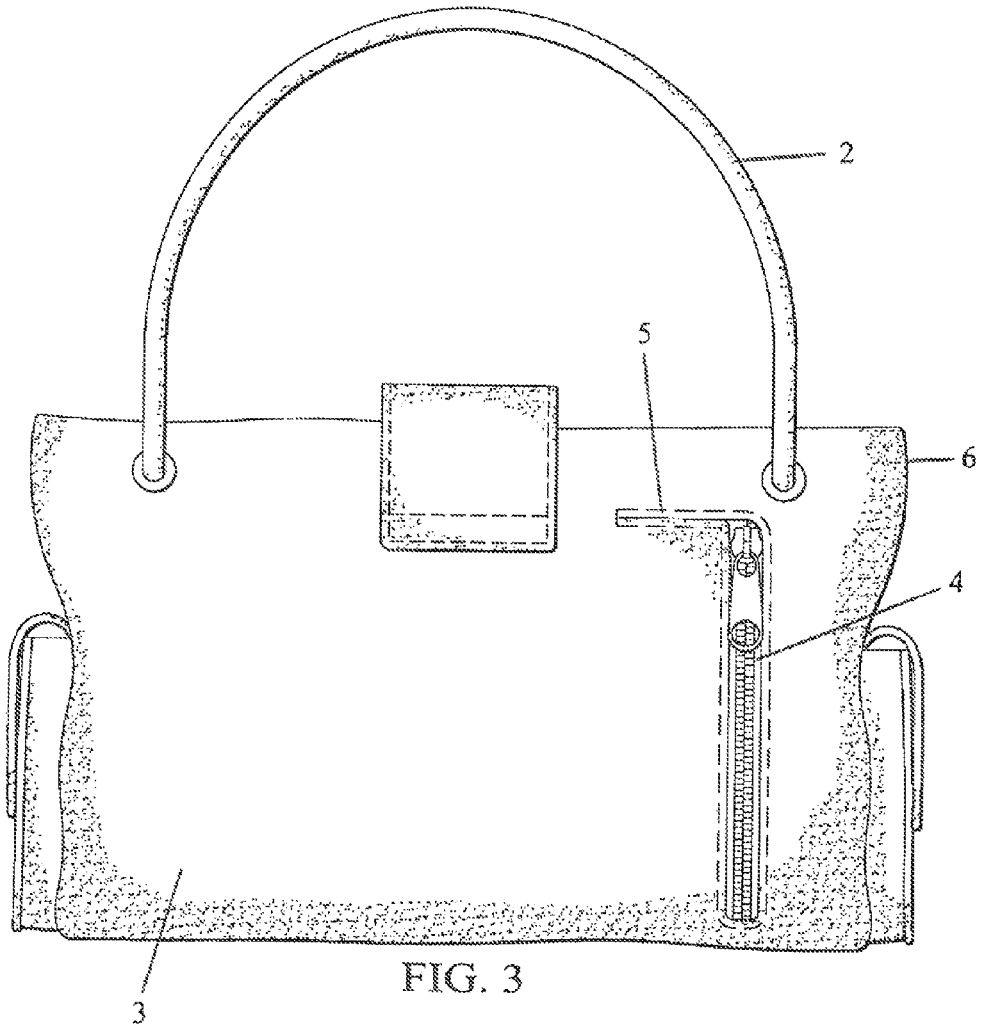
FIG. 3 is a rear view of the holster purse system.

FIG. 3 shows the back view of the holster purse system. At the back of the purse, the back exterior panel 3, containment mechanism 4, and extender 5 are visible. The back exterior panel 3 is directly across from the front exterior panel 1 and on the other side of the interior storage cavity of the purse. Dual side panels are at the end of both the front exterior 1 and back exterior panels 3. The containment mechanism 4 serves to close the holster compartment 8 and ensure the contents of the holster compartment 8 remain inside the holster compartment. In this embodiment, the containment mechanism 4 is a zipper. The extender 5 provides a larger opening area at the edge of the holster compartment 7. The extender 5 the extender runs from a first end of the holster compartment opening to a point between said first end and the opposite edge of the holster purse system, such that the extender 5 is perpendicular to the hoister compartment 8 opening. The extender 5 is comprised of an extra portion of material at the opening of the holster compartment 7 that allows the corner edge of the holster compartment to open wider to prevent snagging as a weapon is inserted into the holster compartment 8.

Figure 4:
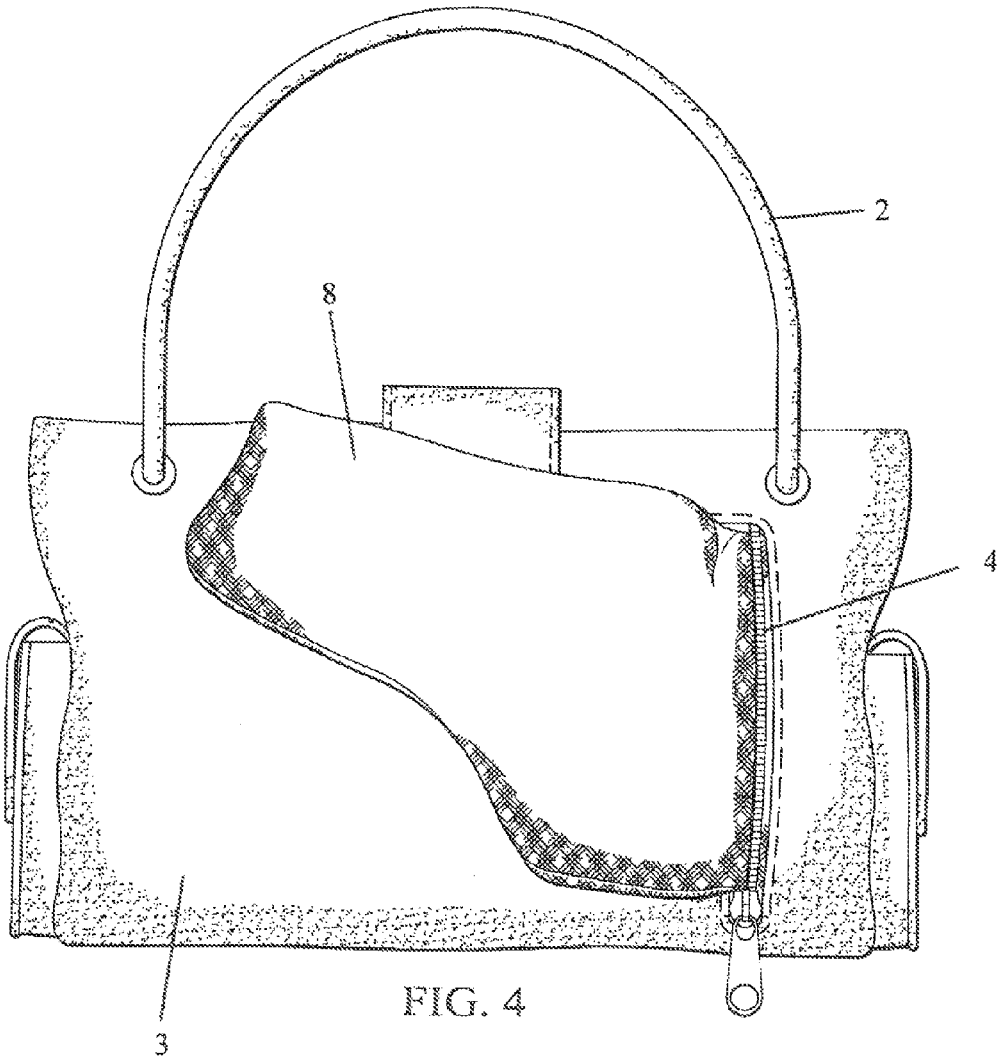
FIG. 4 is a view of the containment mechanism, in an open position.
Figure 5:
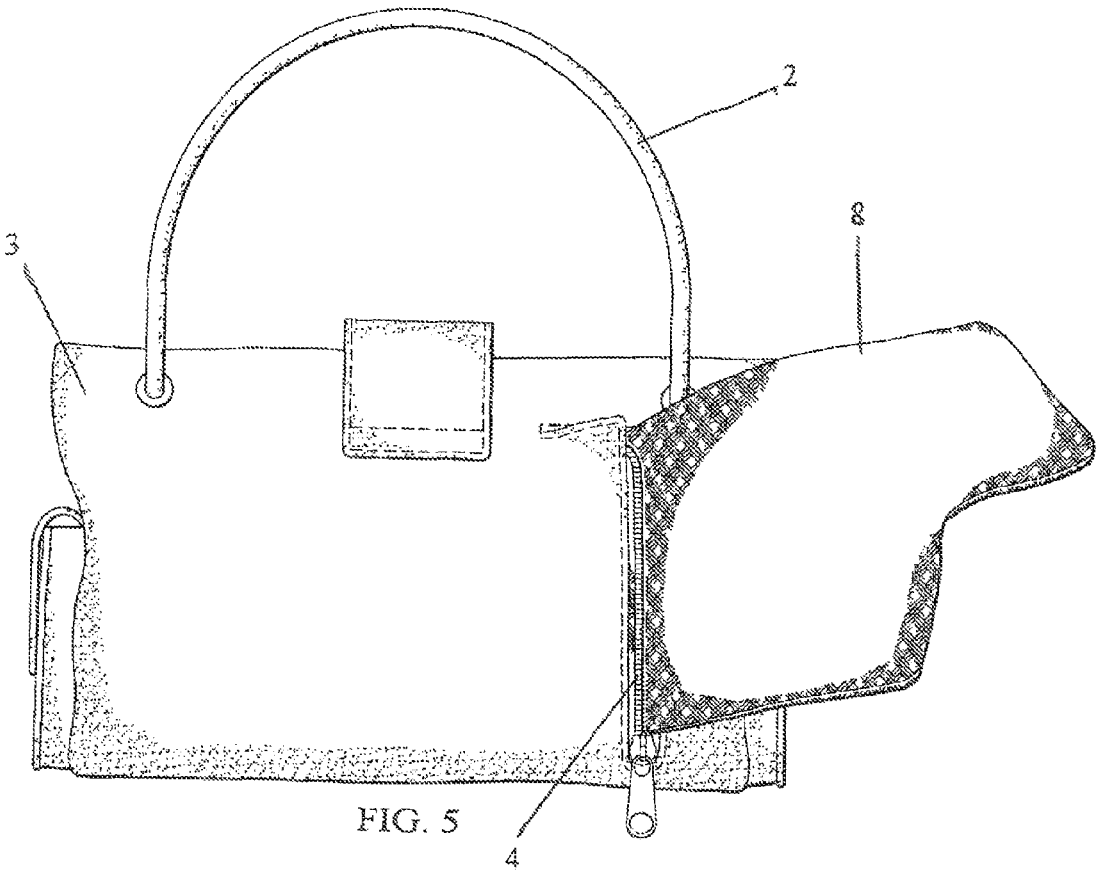
FIG. 5 is a rear view of the holster purse system with the holster compartment exposed.
Figure 6:
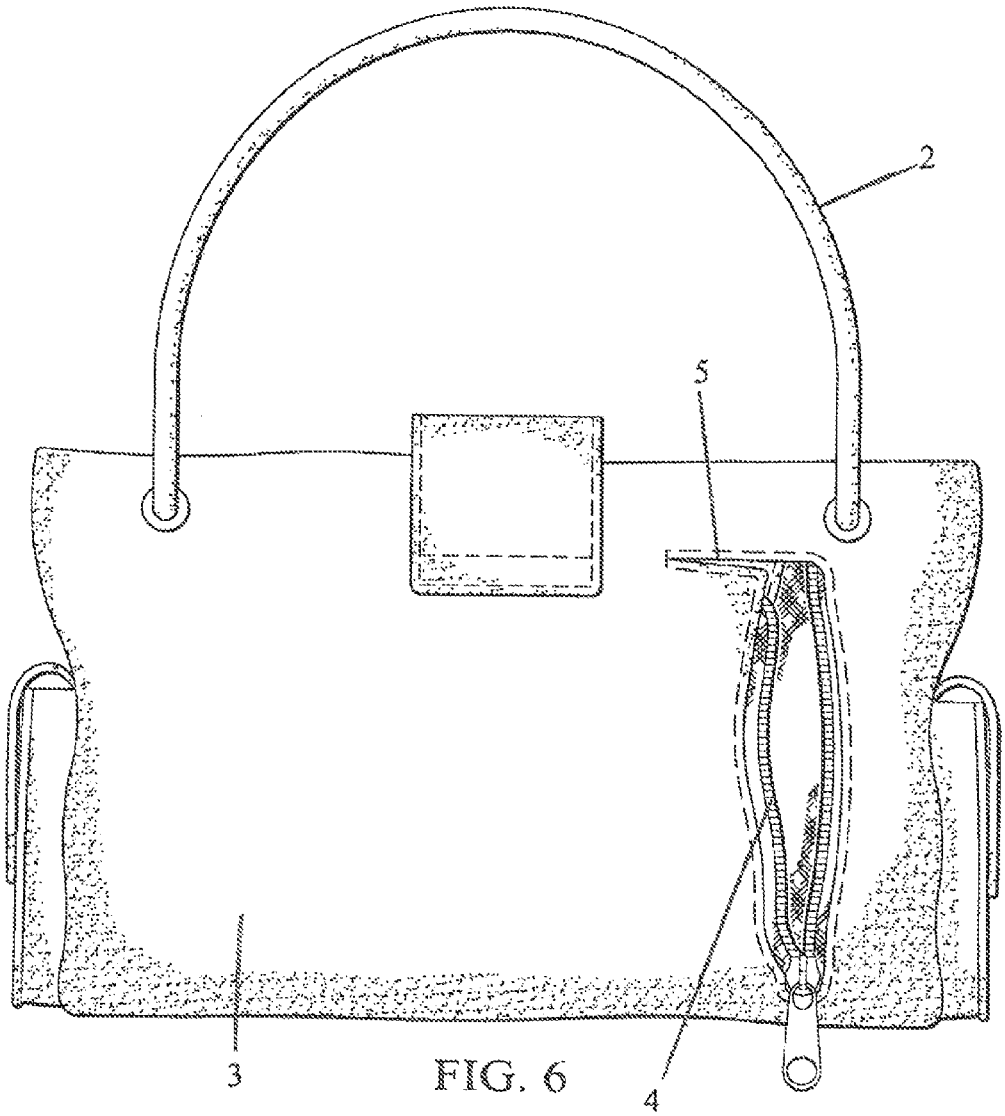
FIG. 6 is a rear view of the holster purse system.
Figure 7:
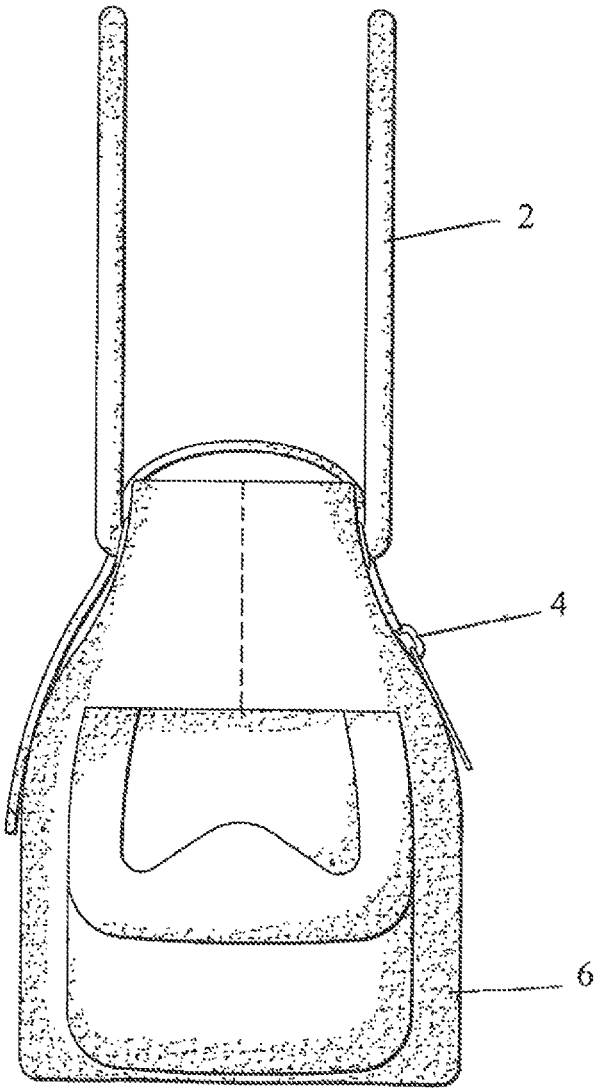
FIG. 7 is a side view of the holster purse system.
Figure 8:
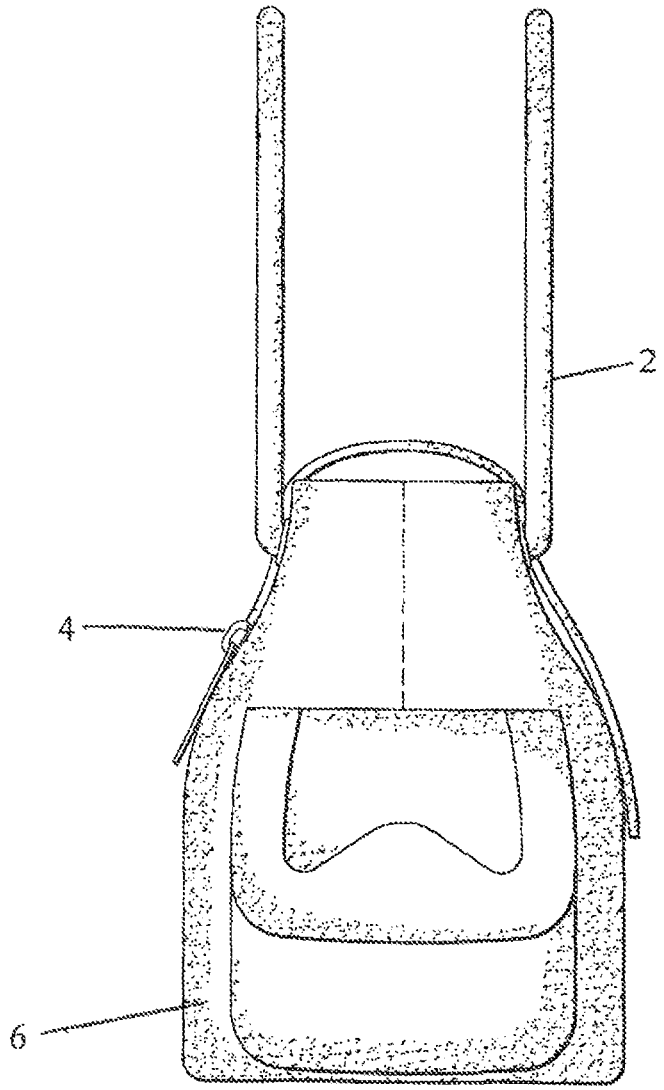
FIG. 8 is a side view of the holster purse system.

When the holster compartment 8 is pulled from the space between the back exterior panel and the interior purse cavity, the holster shape is clearly visible. FIG. 4 shows the holster purse system with the holster compartment 8 in an exposed position. The shoulder straps 2 are attached to the top of the back exterior panel 3. The containment mechanism 4 must be in an open state to expose the hoister compartment 8. The holster compartment can be directed to the left (FIG. 4) or to the right (FIG. 5) when the holster compartment 8 is in an exposed state. To expose the body of the holster compartment, the containment mechanism 4 must be open, FIG. 6 shows the back exterior panel 3 with the containment mechanism 4 in an open position. When the containment mechanism 4 is open, the extender 5 is also open. The open extender 5 creates a larger holster compartment opening allowing a user to insert a weapon into the holster compartment without snagging the weapon. The shoulder straps 2 are attached to the top portion of the back exterior panel 3 and the front exterior panel FIG. 7 is a side view of the holster purse system. In this embodiment, two side exterior panels 6 are located at the edges of the holster purse system. Each side panel 6 is attached to both the front exterior panel 1 and the back exterior panel 3 such that an interior cavity is created in the holster purse system. Users may store personal belongings in the interior cavity of the holster purse system. The holster compartment 8, within the back exterior wall 3, functions to conceal a weapon within the holster purse system. The shoulder straps 2 help secure the holster purse system in position on the user's shoulder. The containment mechanism 4 closes the holster compartment 8 so that the weapon or item in the holster compartment 8 is secure. In this embodiment, the containment mechanism 4 is a zipper but is understood to be any number of closure devices. The holster purse system also includes an extender 5 which creates a larger opening at the edge of the holster compartment 7 for removal and insertion of a weapon into the holster compartment 7 without snagging. FIG. 8 is a view of the opposite side exterior panel 6 of the holster purse system shown in FIG. 7. In this view, the containment mechanism 4 is closed to secure the weapon in the holster compartment. The shoulder straps 2 would rest on the user's shoulder to provide additional security in positioning the holster purse system on the user's body.

Figure 9:
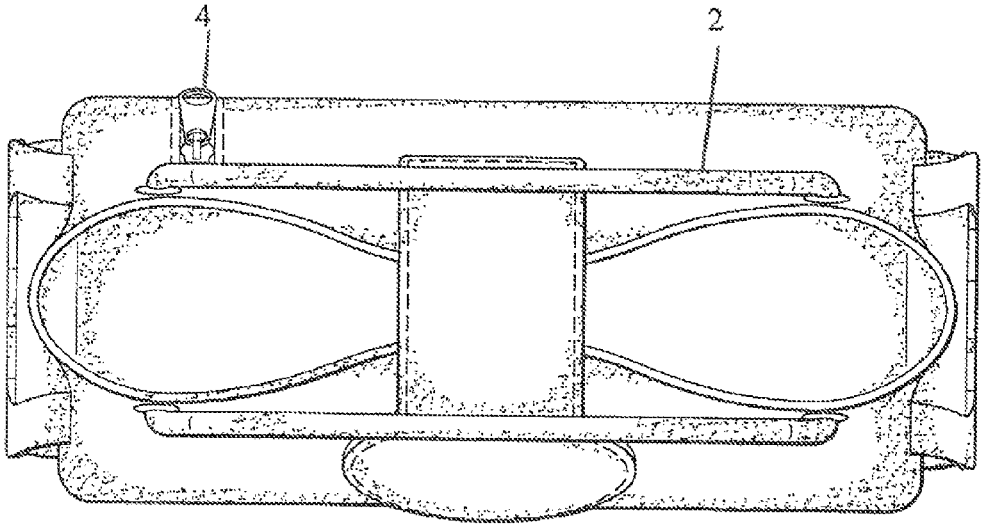
FIG. 9 is a top view of the holster purse system.
Figure 10:
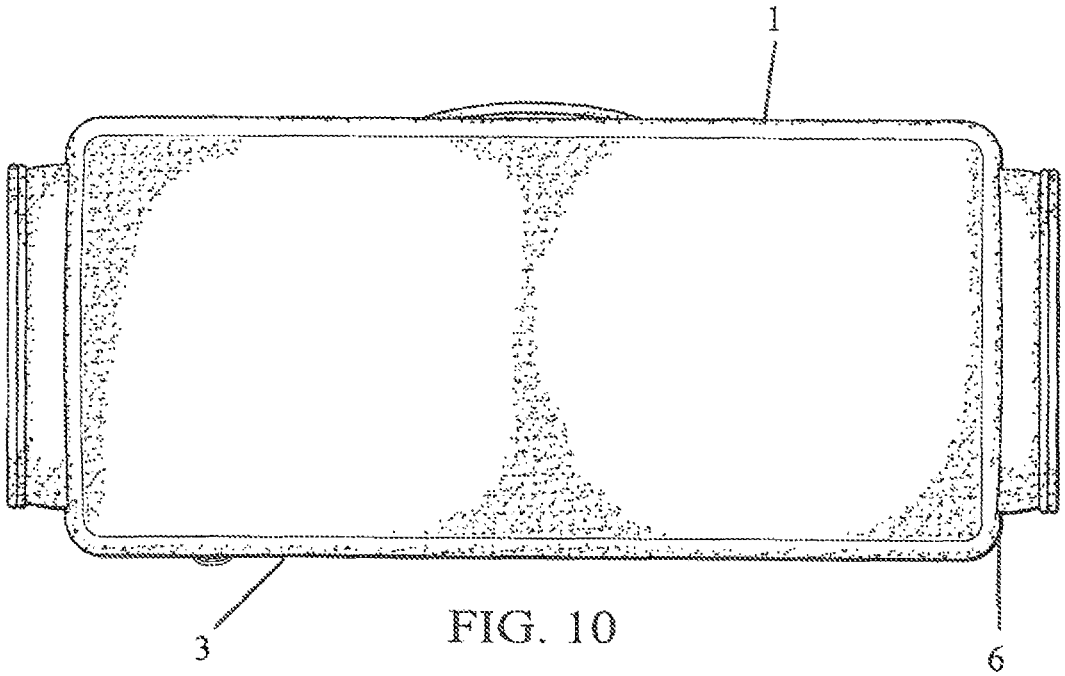
FIG. 10 is a bottom view of the holster purse system.

FIG. 9 is a top v1evv of the holster purse system. The shoulder straps 2, at the top edges of both the front exterior panel 1 and the back exterior panel 3, help secure the holster purse system on the body of the user. The containment mechanism 4 secures the contents of the holster compartment 8. FIG. 10 is a bottom view of the holster purse system. The bottom edges of the front exterior panel 1, dual side panels 6, and the back exterior panel 3 are connected to the bottom panel of the holster purse system such that &'1 interior cavity is created.

Figure 11:
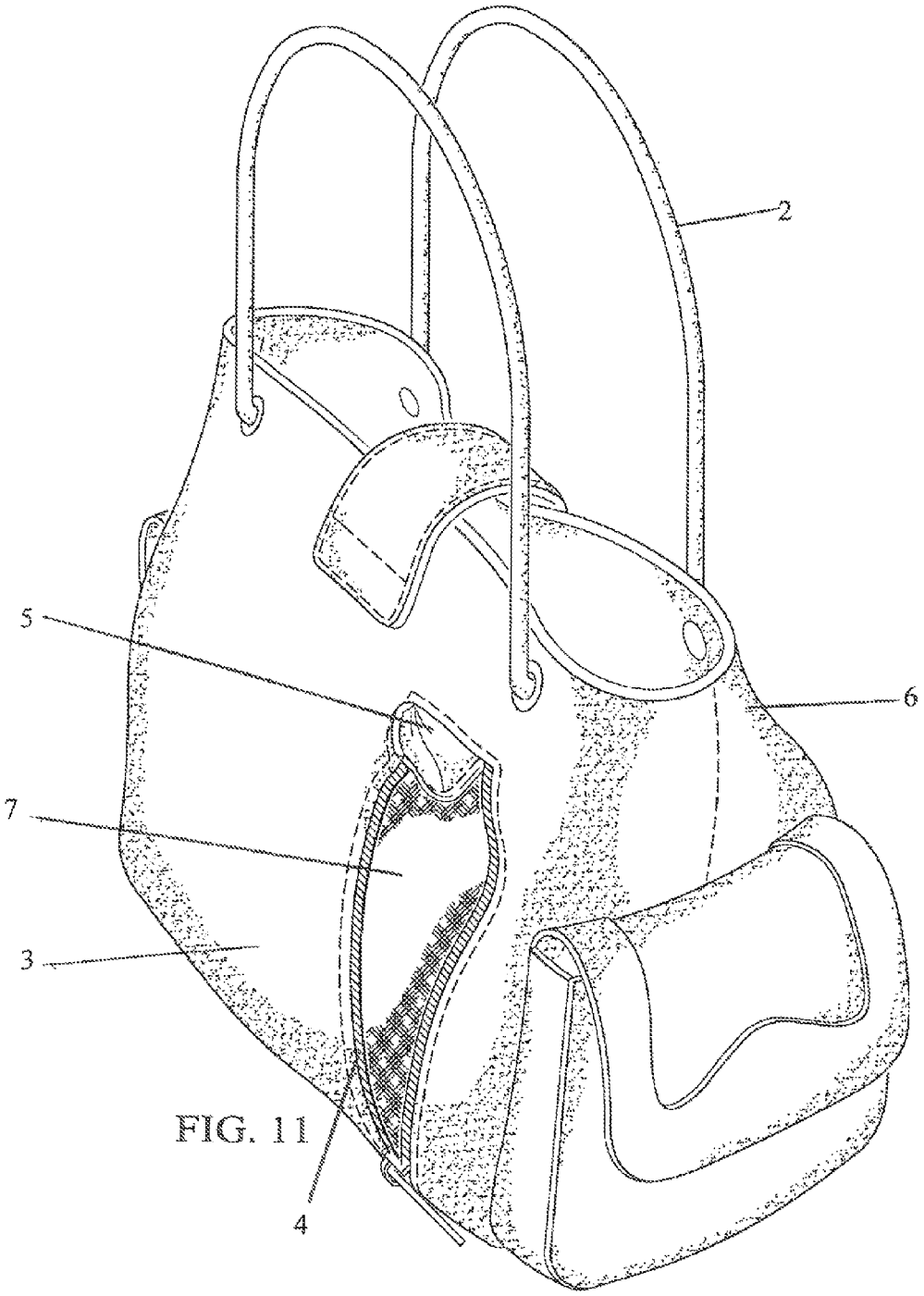
FIG. 11 is a rear perspective view of the holster purse system.

FIG. 11 shows perspective view of the holster purse system with the containment mechanism 4, or zipper, in an open position. The shoulder straps 2 are attached to the front exterior panel 1 and the hack exterior panel 3. The shoulder straps 2 help secure the holster purse system on the shoulder of the user. The shoulder straps also help secure the holster purse system in case of kick back when the weapon is fired. When the containment mechanism 4 is in an open position, the extender 5 will also be expanded to increase the space at the opening of the holster compartment 7. Dual side panels 6 are positioned at both ends of the front exterior panel 1 and the back exterior panel 3.

Figure 12:
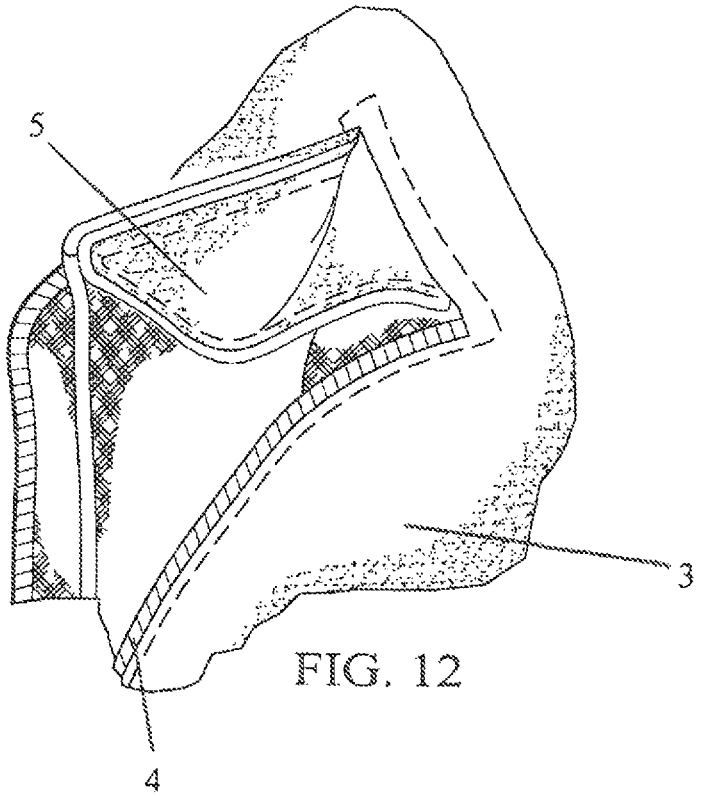
FIG. 12 is a close up view of the extender in an extended position.

FIG. 12 shows a close up view of the extender 5, in an open position. The containment mechanism 4 is also in an open position when the extender is open allowing for insertion of the weapon without snagging at the opening of the holster compartment or on the containment mechanism. The extender 5 and containment mechanism are positioned at the surface of the back exterior panel 3.

Figure 13:
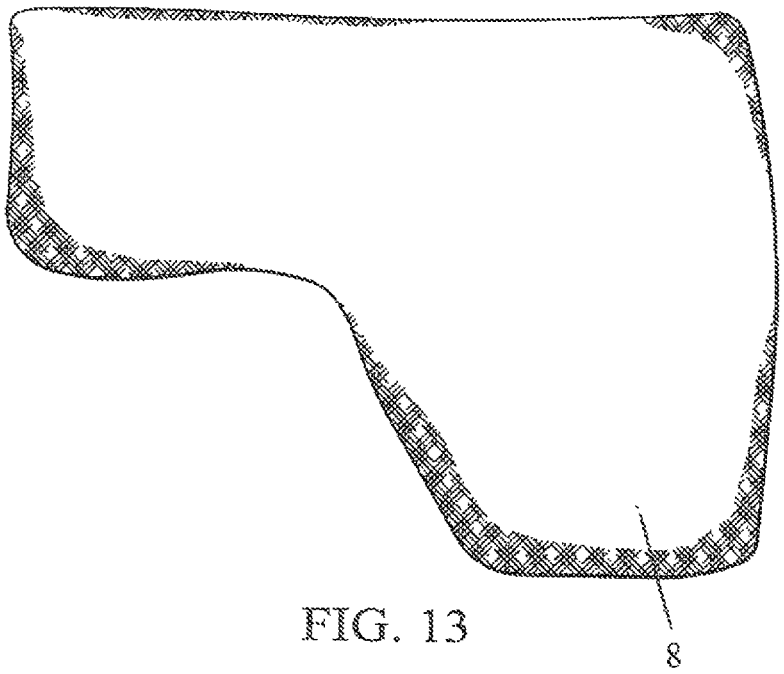
FIG. 13 is a close up view of the holster compartment.

FIG. 13 shows a close up view of the holster compartment 8 separated from the purse holster system, The holster compartment 8 is shaped to mimic the contours of a weapon, a firearm, in this embodiment The holster compartment is positioned within the back exterior panel 3 of the holster purse system, The holster compartment may also be positioned at a downward angle to further secure the weapon in the holster compartment. As the weapon is inserted in the holster compartment, the panel of the weapon will be directed to the far corner of the exterior panel.

Figure 14:
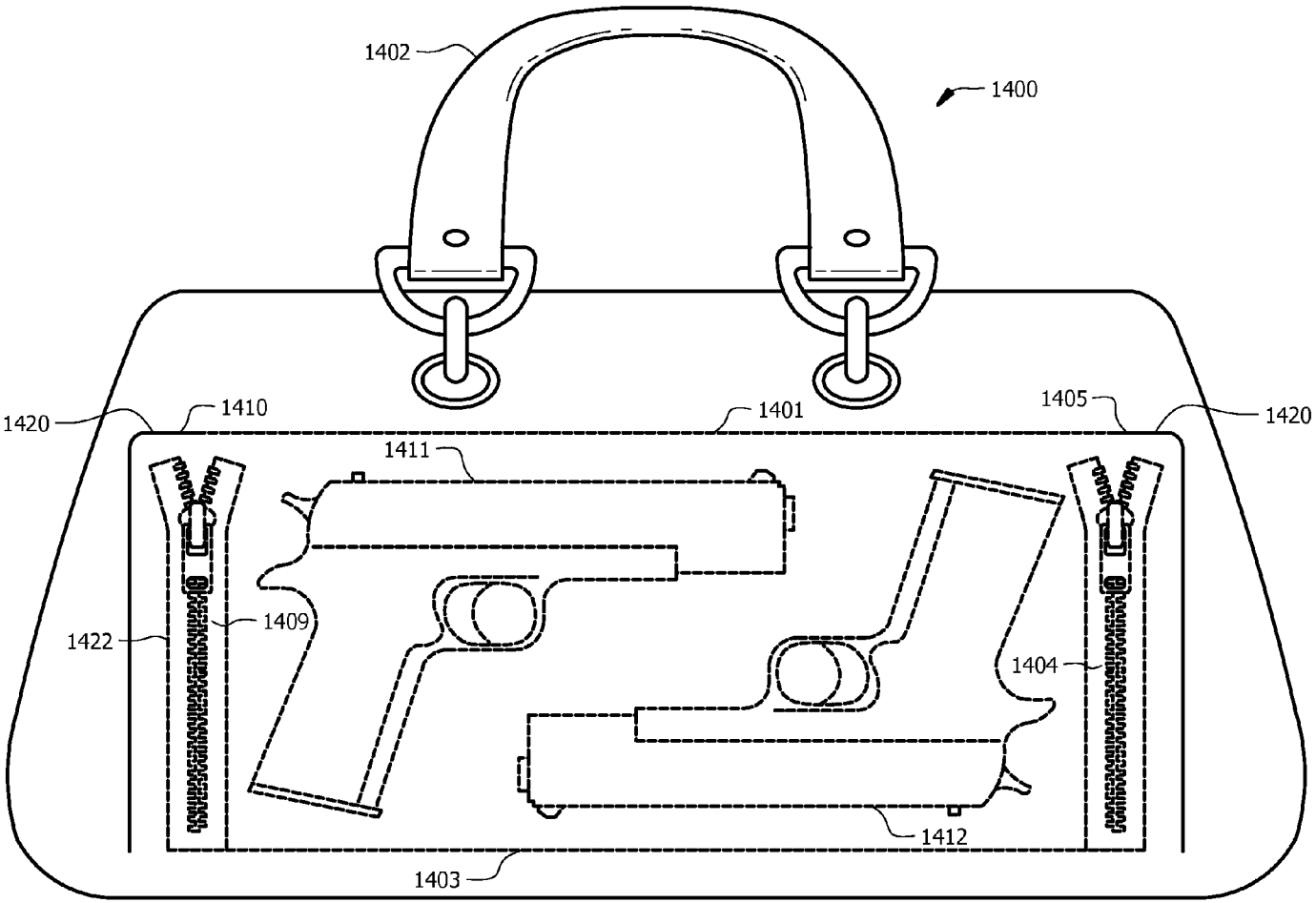
FIG. 14 is a perspective view of a concealed weapon compartment of an embodiment of the present concealed weapon carrying system.

Another embodiment of the presently disclosed concealed weapon carrying system is depicted in FIG. 14. In FIG. 14, carrying item 1400 is a purse, but carrying item 1400 could be a briefcase, backpack or other luggage item. In FIG. 14, purse 1400 includes a pair of concealment compartment openings 1404 and 1409 situated on opposite ends of carrying item 1400 within side panel 1403. In one embodiment, each concealment compartment opening 1404 and 1409 includes a vertical opening having an integrated zipper to execute opening and closing of the concealment compartment openings 1404 and 1409. Carrying item 1400 contains dual concealment compartment openings to accommodate those who may wish to carry multiple handguns and to accommodate both left handed and right handed users. As shown, multiple weapons 1411 and 1412 may be inserted and concealed within side panel 1403. Weapons 1411 and 1412 may be inserted in an interlocking arrangement to fit multiple weapons within the confines of the concealment compartment while making the handle of each weapon 1411 and 1412 accessible to the user. Note that if carrying item 1400 is a purse, the right-handed user tends to wear a purse on the left arm or carry the purse with the left hand. As such, the concealment compartment opening most likely used to accommodate the right-handed user is concealment compartment opening 1404 situated on the right side of side panel 1403, which when the carrying item is in use would face the user.

Similarly, if the user of carrying item 1400 is left-handed, that user would tend to wear the purse on the right arm or carry the purse by handle 1402 with the right hand. As such, the concealment compartment opening most likely used to accommodate the left-handed user is concealment compartment opening 1409 situated on the left side of side panel 1403, which when the carrying item is in use would face the user.

Carrying item 1400 also includes a pair of flaps 1405 and 1410 that cover compartment openings 1404 and 1409 to further enhance concealment. Flaps 1405 and 1410 may be constructed of the same material as side panel 1403 or of another material that blends into side panel 1403. The upper ends 1420 and exterior borders 1422 of flaps 1405 and 1410 are not attached to side panel 1403 so as to permit the user to insert the weapon in concealment compartment 1401, the perimeter of which is shown as dashed lines, and to insert his or her hand in compartment 1401 to retrieve weapon 1411 or 1412.

Figure 15A:
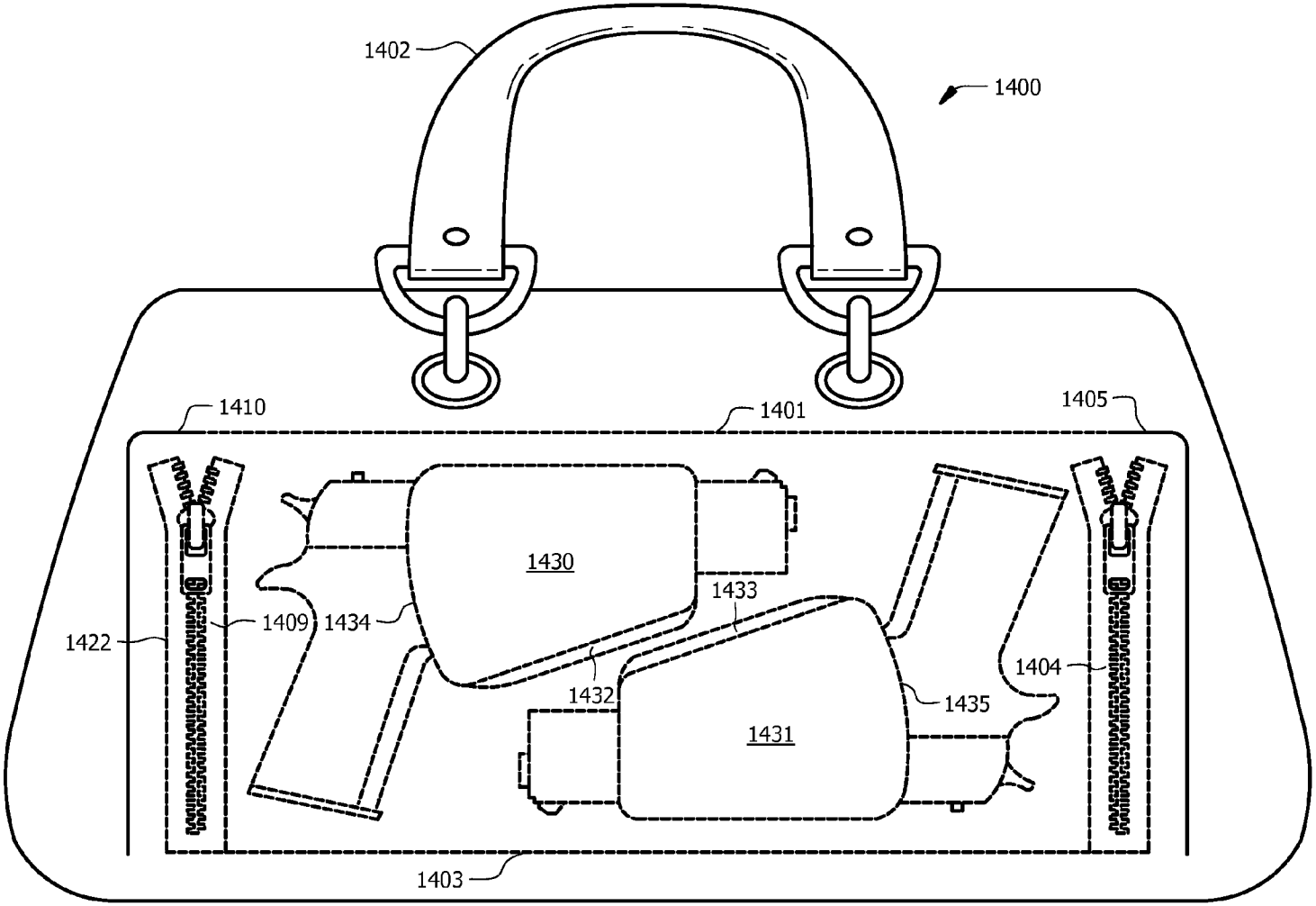
FIG. 15A provides a perspective view of a weapon storage apparatus of a concealed compartment of an embodiment of the present concealed weapon carrying system.
Figure 15B:
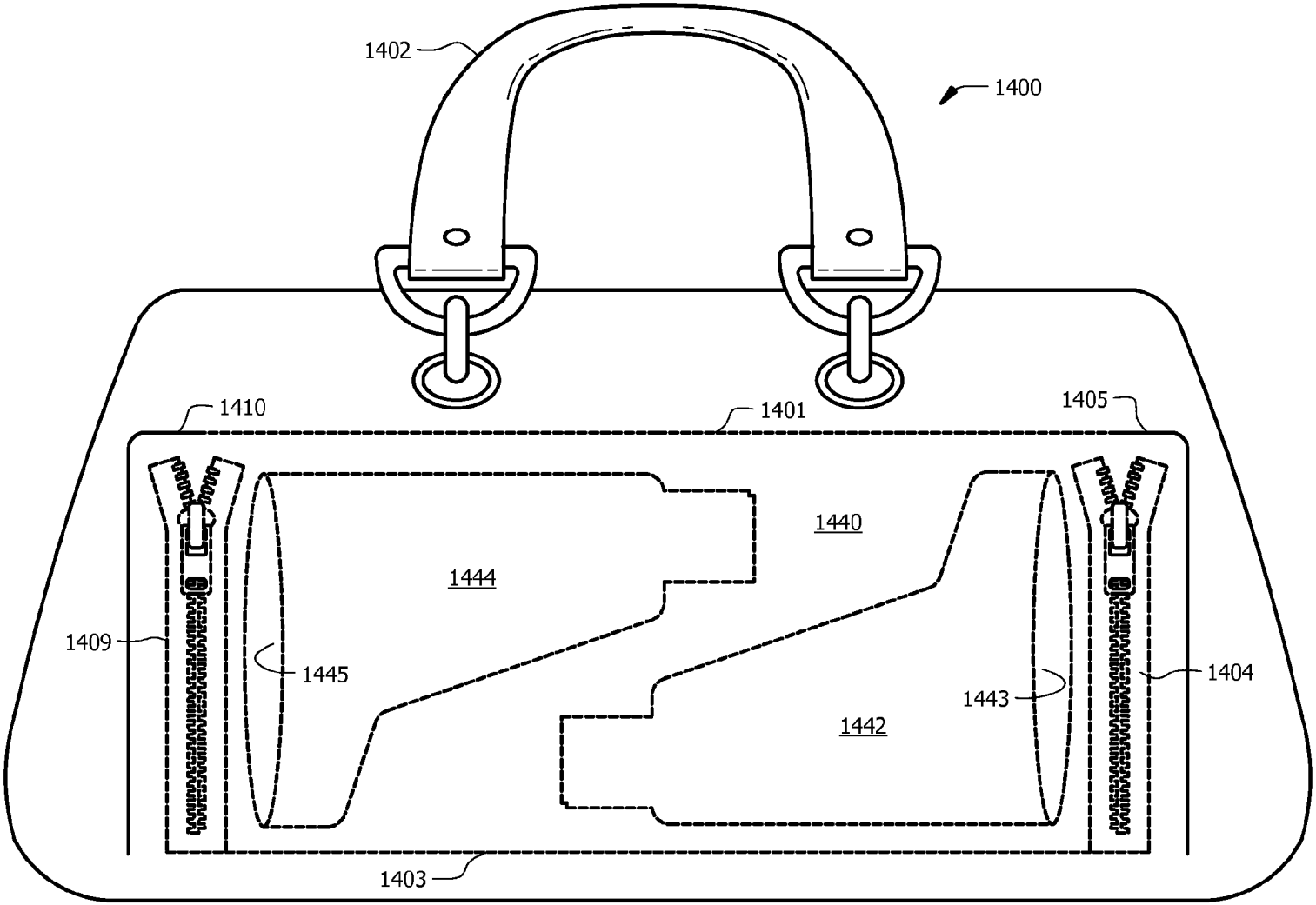
FIG. 15B provides a perspective view of a weapon storage apparatus of a concealed compartment of an embodiment of the present concealed weapon carrying system.

Due to the wide variety of weapons that may be concealed in carrying item 1400, an adaptable holster insert in provided within concealment compartment 1401. The presently described adaptable holster insert prevents the need to loosely place the firearm within concealment compartment 1401 and in turn prevent the weapon from moving about the compartment 1401 that may cause damage to the weapon of unexpected discharge. FIGS. 15A and 15B depict various embodiments of such an adaptable holster insert. In FIG. 15A, carrying item 1400 is again a purse or handbag having a side panel in which concealment compartment 1401 is integrated. Carrying item 1401 includes two compartment openings 1404 and 1409 as depicted in FIG. 14, with each such opening comprising a zipper, a series of snaps or buttons or other suitable device that facilitates the opening and secure closing of the compartments. Each compartment opening 1404 and 1409 is covered by flaps 1405 and 1410, which prevent visibility of compartment openings 1404 and 1409. Flaps 1405 and 1410 include upper edges 1420 and exterior edges 1422 that are not attached to side panel 1403 either through stitching, heat sealing procedures, adhesive or otherwise to permit the user access to concealment compartment 1401.

Within the concealment compartment 1401 of FIG. 15A is a pair of integrated holsters 1430 and 1431. These holsters may be formed from the interior and exterior walls of concealment compartment 1401 formed within side panel 1403. Each integrated holster 1430 and 1431 is loosely shaped to accommodate various sizes and shapes of a concealed weapon, such as a handgun. Various borders of each integrated holster 1430 and 1431 are integrated into the associated interior or exterior wall of concealment compartment 1410 so as to form a pocket for receiving the weapon. Expandable section 1432 and 1433 of integrated holster 1430 and 1431 are fabricated of an expandable or elasticized material so as to permit expansion upon insertion of a weapon followed by sections 1432 and 1433 tightening and fitting snugly around the weapon placed within holsters 1430 and 1431 to secure the weapon in place. Expandable sections may include hook and loop material to allow opening and refastening or may be a single piece construction. As seen in FIG. 15A, the integrated holsters 1430 and 1431 so situated contemplate a concealment compartment 1401 having dual openings 1404 and 1409 as discussed in connection with FIG. 14. The described integrated holster, however, may be adapted to accommodate just a single weapon in a carrying item 1400 having only a single compartment opening on one end of side panel 1403, either compartmental opening 1404 or 1409.

Note that at the time of purchase a handgun usually comes with a customized holster that serves to protect the weapon and acts as a trigger guard against accidental discharge of the weapon. Other weapons, such as knives and mace come with similar holster-type holders or a sheath, etc. In this regard, integrated holsters 1430 and 1431 serve as a substitute for the primary holster if the user wishes to remove the weapon from the manufacturer provided holster. As noted, the integrated holsters 1430 and 1431 are sized and shaped to accommodate various weapons and the elastic properties of expandable sections 1432 and 1433 so sufficient protection of the weapon is provided and integrated holsters 1430 and 1431 keep the handgun trigger guarded to prevent accidental discharge.

Note that a user inserting a weapon inside of the present concealment system desires safe storage of the weapon and easy and efficient removal in case the weapon must be drawn. Efficient and easy removal is achieved when the weapon is removed from the bag in rapid fashion if necessary while the holster remains in the concealment compartment. The embodiment of the present system as described in FIG. 15A accomplishes this by providing secure means for storing a weapon within the concealment compartment and by provide ease of removal. Integrated holsters 1430 and 1431 achieve this by providing holsters that remain in the concealment compartment as the weapon is removed.

While the embodiment described above describes an integrated holster fabricated much like a traditional holster in terms of size, shape and material, other forms of the integrated holster are contemplated. By example, the body of the integrated holster may be made of foam or other padded material. Similarly, the integrated holster may include zipper components or buttons or snaps to allow the holster to be secured within the concealment compartment, with male and female portions of such fasteners situated on the holster and within the interior of the concealment compartment as appropriate. In addition, the concealment compartment may be magnetized to provide the necessary resistance to movement of the weapon while stored yet permit ease of removal when the weapon is needed. A magnet may be integrated into the fabric of material of which the carrying item is made or within the integrated holster to attract the metal weapon.

FIG. 15B depicts another embodiment of the present concealed weapon carrying system. In FIG. 15B, carrying item 1400 is once again a purse or handbag having a concealment compartment 1401 formed within side panel 1403 with dual concealment compartment openings 1404 and 1409 situated at opposite ends of compartment 1401. As previously described, compartment openings 1404 and 1409 may be further concealed by flaps 1405 and 1410 covering openings 1404 and 1409, respectively. In this alternative embodiment, an elongated foam member 1440 that substantially occupies the void within concealment compartment 1401 formed within side panel 1403 of carrying item 1400. Foam member may be constructed of standard polyurethane or enhanced to act as a memory foam as is known in the art. In one embodiment, foam member 1440 is a continuous mass of memory foam in which openings 1443 and 1445 at opposite ends of foam member are formed in order to allow insertion of a weapon. Within foam member 1440 and inward in relation to openings 1443 and 1445 are void sections 1442 and 1444. As seen in FIG. 15B, void sections 1442 and 1444 are loosely shaped in the form of a handgun. In operation, the user inserts a handgun through opened compartment opening 1404 or 1409 and further inserts the handgun through opening 1442 or 1445, penetrating foam member 1440. The elastic properties of foam member 1440 expand as the handgun is inserted and once in place contact around the handgun to secure the handgun in place within concealment compartment 1401. This configuration promotes secure placement of the handgun within a purse or handbag to prevent unwanted movement of the gun to further prevent damage to the weapon or accidental discharge. Foam member 1440 may be appropriately coated to prevent tearing of the foam member due to repetitive insertion and removal of the weapon from concealment compartment 1401.

As discussed above, safely storing a weapon within the concealment compartment so as to prevent damage and accidental discharge of the weapon is of importance to the user. In connection with the embodiment of FIG. 15B, the user may leave the weapon within the manufacturer provided or external holster and insert the weapon with external holster into the foam member 1440. Foam member 1440, with its elastic and expandable and contractible properties provides necessary friction and gripping properties to hold the user's external holster in place when the weapon is removed from the concealed compartment. In the alternative, the user may insert the weapon without the external holster depending on the density and other qualities of the foam used to manufacture foam member 1440, although insertion with the external holster may provide added security. Further, other securing features may be incorporated into foam member 1440 such as those discussed above in connection with integrated holsters 1430 and 1431. Magnets may be incorporated at appropriate areas of foam member 1440 to attract the weapon and maintain a secure position within the concealment compartment but at the same time allow quick and efficient removal of the weapon. Other fastening means may be incorporated into foam member 1440, such as buttons or snaps or straps to provide more secure placement of the weapon.

In one embodiment, it is contemplated that the inserts described in connection with FIGS. 15A and 15B are permanent affixed within compartment 1401. In alternative embodiment, holster inserts may be modular and interchangeable in order to accommodate different sized and types of weapons. By example, an insert having a single or multiple void sections may be shaped and sized to accommodate other concealed items such as mace, pepper spray, a knife or other item used for self-protection. Further, as discussed in connection with FIG. 15A, carrying item 1401 is described as having dual compartment openings. A single opening carrying item providing single side access to concealment compartment 1401 is also contemplated as an alternative embodiment that will nevertheless receive a foam member for secure placement of a concealed weapon as described herein.

Figure 16:
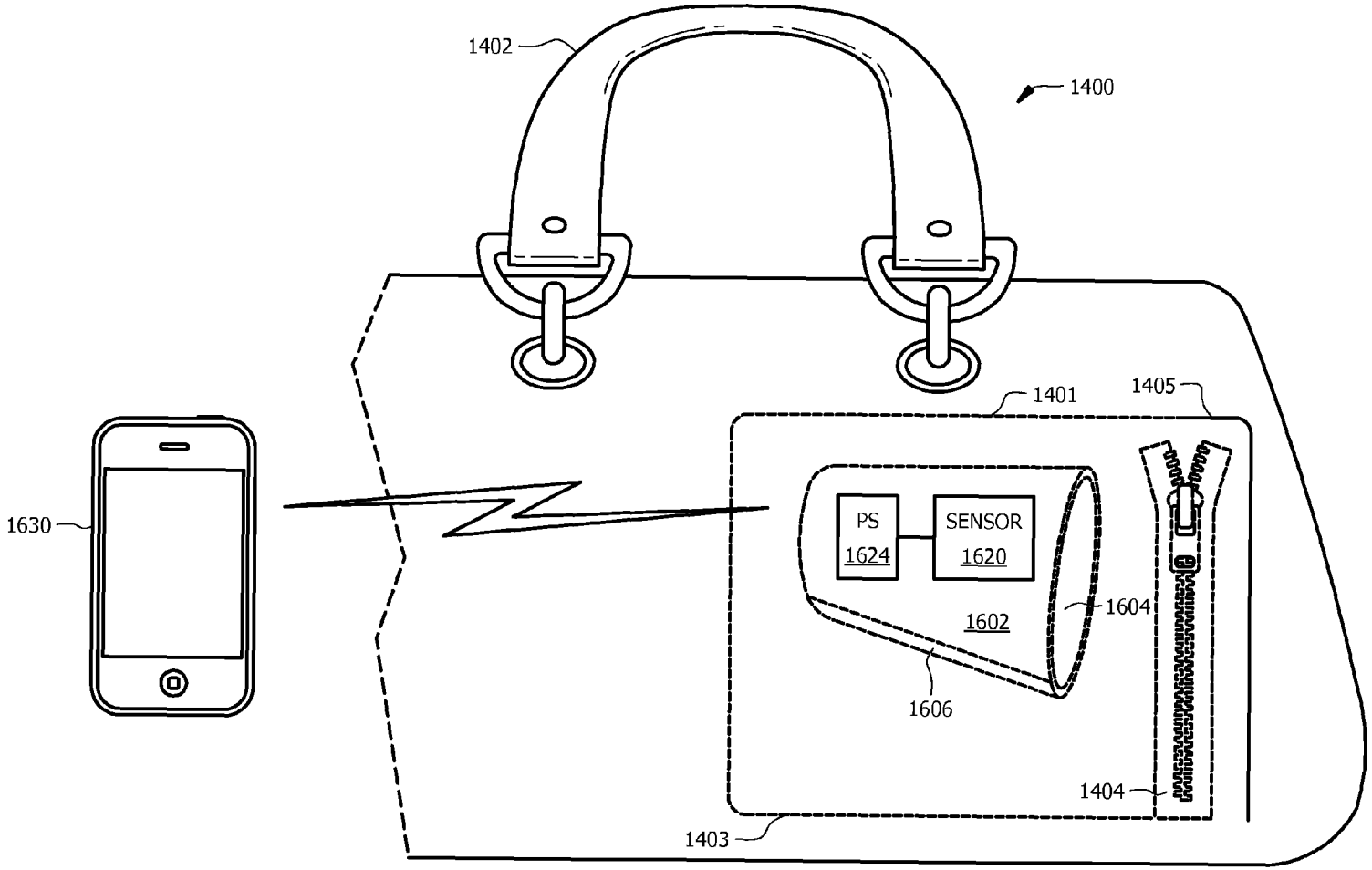
FIG. 16 provides a perspective view of a weapon placement indicator of a concealed compartment of an embodiment of the present concealed weapon carrying system.

FIG. 16 depicts another embodiment of the present concealed weapon carrying system in which a sensor to provide an indication of the presence and further security of a weapon within the concealment compartment of the carrying item is described. In FIG. 16, a carrying item 1400 is shown configured to accept a single weapon for concealment. Carrying item 1400 includes a concealment compartment 1401 integrated into and formed from an interior and exterior wall formed within side panel 1403 of carrying item 1400, which again in this embodiment is a purse or handbag.

As previously described, situated on one end of side panel 1403 is compartment opening 1404 that may be closed by a fastener such as a zipper. Other suitable fasteners may be substituted. Within concealment compartment 1401 is an integrated holster 1602 similar to that described in connection with FIG. 15A. In this embodiment, a single holster is implemented, although a dual configuration such as that described in FIG. 15A is also contemplated. Integrated holster 1602 is integrated into the interior and exterior walls within compartment 1401 by stitching, adhesive or other means of joining multiple edge members of holster 1602. Holster 1602 also includes expandable section 1606, which may be fabricated of an expandable or elasticized material so as to permit expansion upon insertion of a weapon with expandable section 1606 then tightening and fitting snugly around the weapon placed within holster 1602 to secure the weapon in place. Situated within integrated holster 1602 is sensor 1620 powered by power supply 1624, which may be a low voltage battery. Detector 1602 may be an RFID detector that detects the presence of an RFID tag coming within very close proximity to sensor 1620. Other suitable sensors that detect the presence of an item through recognition of weight, motion or otherwise may be employed.

In one embodiment, an RFID tag (not shown) is adhered to a weapon to be concealed within concealment compartment 1401. Once a weapon on which an RFID tag is placed is secured within integrated holster 1602, RFID sensor 1620 detects the presence of an item within integrated holster 1602. Carrying item 1400 may be equipped with a transmission capability of a known wireless protocol, such as Bluetooth, Zigbee, etc. to communicate with an indicator either situated within carrying item 1400. By example, carrying item 1400 may be equipped with an LED indicator at an inconspicuous location to serve as an indicator that a weapon is indeed secured within integrated holster 1602 once sensor 1620 detects the presence of an item within holster 1602. In the alternative, sensor 1620 may communicate with a smartphone, personal digital assistance, computer or other suitable device 1630 via a wireless network medium to indicate the presence of an item within integrated holster 1602. Device 1630 will have stored in memory an application that will permit communication with sensor 1620 and appropriate messaging of the status of the interior holster 1602 and/or concealment compartment 1401. More sophisticated applications may be implemented in association with sensor 1620 to prevent unlocking and therefore discharge of a concealed weapon placed in concealment compartment 1401 when the weapon is located more than a desired distance from carrying item 1400.

While the above description is of the various embodiments of the present invention, it should be appreciated that the invention may be modified, altered, or varied without deviating from the scope of the invention and fair meaning of the following claims.

ADDITIONAL DESCRIPTION

The following clauses are offered as further description of the disclosed invention.

Clause 1. A system for concealing a weapon, comprising:

a compartment formed from a first interior side of a personal item carrier and an inner face of an exterior side of the personal item carrier;

a first access port formed within an exterior side of a personal item carrier; and a first tapered weapon holder, comprising:

a first inward side formed within the first interior side of the personal item carrier;

a first outward side formed within the inner face of the exterior side of the personal item carrier;

a first expandable panel connecting the inward side and the outward side.

Clause 2. The system of any proceeding or preceding clause, wherein the personal item carrier is formed of a pliable material.

Clause 3. The system of any proceeding or preceding clause, further comprising a magnet integrated into the compartment for securing a first weapon within the first tapered weapon holder.

Clause 4. The system of any proceeding or preceding clause, further comprising a second access port formed within the exterior side of the personal item carrier at an area remote from the first access port.

Clause 5. The system of any proceeding or preceding clause, further comprising a second tapered weapon holder, comprising:

a second inward side formed within the first interior side of the personal item carrier;

a second outward side formed within the inner face of the exterior side of the personal item carrier; and a second expandable panel connecting the inward side and the outward side.

Clause 6. The system of any proceeding or preceding clause, further comprising:

a sensor associated with the first weapon holder; and a tag associated with a first weapon received by the first tapered weapon holder, wherein the tag is sensed by the sensor when the first weapon is secured within the first tapered weapon holder.

Clause 7. The system of any proceeding or preceding clause, further comprising an indicator remote from the first tapered weapon holder and activatable by the presence of the first weapon by the sensor.

Clause 8. A system for concealing a weapon, comprising:

a compartment formed from a first interior side of a personal item carrier and an innerface of an exterior side of the personal item carrier;

a first access port formed within an exterior side of a personal item carrier; and a first insert formed to substantially occupy the compartment, comprising a first tapered orifice having an open end aligned with the first access port and a distal end;

wherein the first tapered orifice is sized to grip a first protective cover containing the first weapon as the first weapon is removed from the first protective cover.

Clause 9. The system of any proceeding or preceding clause, further comprising a first fastener integrated into the first orifice for securing a first weapon received by the first orifice.

Clause 10. The system of any proceeding or preceding clause, wherein the personal item carrier is formed of a pliable material.

Clause 11. The system of any proceeding or preceding clause, further comprising a magnet integrated into the compartment for securing the first weapon within the first tapered orifice.

Clause 12. The system of any proceeding or preceding clause, further comprising a second access port formed within the exterior side of the personal item carrier.

Clause 13. The system of any proceeding or preceding clause further comprising a second tapered orifice having an open end aligned with the second access port and a distal end within the exterior side of the personal item carrier at an area remote from the second access port.

Clause 14. The system of any proceeding or preceding clause further comprising a second fastener integrated into the second tapered orifice for securing a second weapon received by the second tapered orifice.

Clause 15. The system of any proceeding or preceding clause, further comprising:

a sensor associated with the first tapered orifice; and a tag associated with a first weapon received by the first tapered orifice, wherein the tag is sensed by the sensor when the first weapon is secured within the first tapered orifice.

Clause 16. The system of any proceeding or preceding clause, further comprising an indicator remote from the first tapered orifice and activatable by the presence of the first weapon by the sensor.

Clause 17. The system of any proceeding or preceding clause, wherein the first weapon is selected from the group consisting of a gun, a knife, and sprayable repellent.

Clause 18. A method for securing a weapon within a personal item carrier, comprising the steps of:

receiving within a weapon protection insert integrated into at least one interior side of the personal item carrier a weapon;

expanding the weapon protection insert beyond an exterior dimension of the weapon received by the weapon protection insert; contracting the weapon protection insert to secure the weapon within the weapon protection insert; and fastening the weapon with the weapon protection insert by adjoining a corresponding first part of a fastener integrated into the weapon protection insert with the weapon.

Clause 19. The method of any proceeding or preceding clause, wherein the weapon protection insert is shaped to conform to the exterior dimension of the weapon.

Clause 20. The method of any proceeding or preceding clause, wherein the fastener is selected from the group consisting of a magnet, a button, a snap, a clip, a strap or a hook and loop fastener.

Clause 21. A holster system for securing a weapon, said holster system comprising:

a carrying case;

a compartment; and a containment mechanism.

Clause 22. The holster of any proceeding or preceding clause wherein said carrying case is comprised of an interior cavity surrounded by at least two exterior walls.

Clause 23. The holster of any proceeding or preceding clause wherein said compartment contains an opening at a single edge of said compartment, wherein said compartment is positioned within a first wall of said exterior walls.

Clause 24. The holster system of any proceeding or preceding clause wherein said opening of said compartment is surrounded by said containment mechanism, wherein said containment mechanism is comprised of a first member and a second member.

Clause 25. The holster system of any proceeding or preceding clause wherein the unfastening of said first member to said second member serves to close said containment mechanism, thereby securing said opening of said compartment.

Clause 26. The holster system of any proceeding or preceding clause wherein said opening contains an extender, wherein said extender is positioned at a first end of said opening, wherein said extender is perpendicular to said containment mechanism of said opening.

Clause 27. The holster system of any proceeding or preceding clause wherein the unfastening of said first member from said second member serves to open said containment mechanism, thereby unsecuring said opening of said compartment.

Clause 28. The holster system of any proceeding or preceding clause wherein said containment mechanism is selected from the group consisting: zipper, slider, hook and loop fasteners, and snaps.

Clause 29. The holster system of any proceeding or preceding clause wherein said compartment is shaped to mimic the contours of a weapon such that said weapon is secure when placed inside said compartment.

Clause 30. The holster system of any proceeding or preceding clause wherein said weapon is selected from the group consisting of firearm, stun gun, mace, pepper spray, and knife.

We claim:

1. A system for concealing a weapon, comprising:

a compartment formed from a first interior side of a personal item carrier and an innerface of an exterior side of the personal item carrier;

a first access port formed within the exterior side of a personal item carrier; and a first insert formed to substantially occupy the compartment, comprising a first tapered orifice having an open end aligned with the first access port and a distal end;

wherein the first tapered orifice is sized to grip a first protective cover containing a first weapon as the first weapon is removed from the first protective cover;

wherein the first insert comprises a foam member, and wherein the foam member comprises a void in a similar shape to said first weapon.

2. The system of claim 1, further comprising a first fastener integrated into the first orifice for securing a first weapon received by the first orifice.

3. The system of claim 1, wherein the personal item carrier is formed of a pliable material.

4. The system of claim 1, further comprising a magnet integrated into the compartment for securing the first weapon within the first tapered orifice.

5. The system of claim 1, further comprising a second access port formed within the exterior side of the personal item carrier.

6. The system of claim 5 further comprising a second tapered orifice having an open end aligned with the second access port and a distal end within the exterior side of the personal item carrier at an area remote from the second access port.

7. The system of claim 6 further comprising a second fastener integrated into the second tapered orifice for securing a second weapon received by the second tapered orifice.

8. The system of claim 1, further comprising:

a sensor associated with the first tapered orifice; and a tag associated with a first weapon received by the first tapered orifice, wherein the tag is sensed by the sensor when the first weapon is secured within the first tapered orifice.

9. The system of claim 8, further comprising an indicator remote from the first tapered orifice and activatable by the presence of the first weapon by the sensor.

10. The system of claim 1, wherein the first weapon is selected from the group consisting of a gun, a knife, and sprayable repellent.

* * * * *